US006661636B2

(12) United States Patent
Koch

(10) Patent No.: US 6,661,636 B2
(45) Date of Patent: Dec. 9, 2003

(54) METHOD FOR CONTROLLING AN ELECTROMECHANICAL ACTUATOR DRIVE

(75) Inventor: Achim Koch, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/100,578

(22) Filed: Mar. 18, 2002

(65) Prior Publication Data

US 2002/0112682 A1 Aug. 22, 2002

Related U.S. Application Data

(63) Continuation of application No. PCT/DE00/03113, filed on Sep. 7, 2000.

(30) Foreign Application Priority Data

Sep. 16, 1999 (DE) ..... 199 44 520

(51) Int. Cl.[7] ..... H01H 9/00; F01L 9/02

(52) U.S. Cl. ..... 361/154; 361/152; 361/146; 361/195

(58) Field of Search ..... 361/143, 144, 361/146, 152, 156, 195; 123/478, 490; 318/126

(56) References Cited

U.S. PATENT DOCUMENTS 4,974,622 A * 12/1990 Rader ..... 137/1
5,708,355 A * 1/1998 Schrey ..... 323/282
5,742,467 A * 4/1998 Schmitz ..... 361/154
5,748,433 A * 5/1998 Schrey et al. ..... 123/90.11

FOREIGN PATENT DOCUMENTS

| | | |
|---|---|---|
| DE | 37 33 704 A1 | 4/1988 |
| DE | 43 19 918 A1 | 12/1994 |
| DE | 195 18 056 A1 | 11/1996 |
| DE | 195 26 681 A1 | 1/1997 |
| DE | 195 31 437 A1 | 2/1997 |
| DE | 297 12 502 U1 | 10/1997 |
| DE | 196 23 698 A1 | 12/1997 |
| EP | 0 724 067 A1 | 7/1996 |

* cited by examiner

*Primary Examiner*—Kim Huynh
(74) *Attorney, Agent, or Firm*—Laurence A Greenberg; Werner H. Stemer; Ralph E. Locher

(57) ABSTRACT

So that an actuator drive which holds an actuator element for actuating, for example, a charge cycle valve of an internal combustion engine, in a limit position by a coil, can be switched at the correct time into the other limit position, the energization of the coil is switched off a certain time period before the time at which the actuator element is to be released from the limit position. Here, the time period is selected as a function of the supply voltage of the actuator drive and/or of the coil current during the holding in the limit position. It is also possible to adapt the time period.

4 Claims, 6 Drawing Sheets

METHOD FOR CONTROLLING AN ELECTROMECHANICAL ACTUATOR DRIVE

CROSS-REFERENCE TO RELATED APPLICATION

This application is a continuation of copending International Application No. PCT/DE00/03113 filed Sep. 7, 2000, which designated the United States.

BACKGROUND OF THE INVENTION

Field of the Invention

The invention relates to a method for controlling an electromechanical actuator drive.

Internal combustion engines whose charge cycle valves are activated independently of the camshaft are known. In contrast to charge cycle valves that are activated by the camshaft, the charge cycle valves are actuated so as to open and close in dependence on a rotary position of the crankshaft. There is no fixed mechanical coupling to the crankshaft. Examples of electromechanical actuator drives for charge cycle valves are known from German Utility Model DE 297 12 502 U1 or Published, European Patent Application EP 0 724 067 A1. They have a position of rest that lies between a closed position and an open position and from which they can be deflected by electromagnets.

In order to open or close a charge cycle valve, the coil of the respective electromagnet is energized, the necessary current being greater in a capture phase than in a holding phase in which the charge cycle valve is held in a limit position.

Whereas there is no predefinition of the control times in the operating control unit of the internal combustion engine in the conventional, camshaft-activated valve driving mode, in electromechanically activated charge cycle valves corresponding control times must be calculated and predefined.

It is necessary to take into account here the fact that together with the actuator drive and its springs the charge cycle valve constitutes a spring-mass oscillator. Its natural frequency or resonant frequency determines the speed at which the valve can be moved between the limit positions.

As a result of the physical conditions a minimum actuating time from one limit position to the other limit position is predefined. It is known to take into account the minimum actuating time in the calculation of the control times.

From Published, Non-Prosecuted German Patent Application DE 195 26 681 A1, it is known to switch off the energization of the coil holding the actuator element in the limit position a certain time period before the time at which the actuator element is to be released from the limit position, because what is referred to as sticking of the actuator element in a limit position occurs as a result of mechanical and magnetic effects in the actuator drive. This is also mentioned in Published, Non-Prosecuted German Patent Applications DE 195 31 437 A1, DE 196 23 698 A1 and DE 195 18 056 A1.

SUMMARY OF THE INVENTION

It is accordingly an object of the invention to provide a method for controlling an electromechanical actuator drive that overcomes the above-mentioned disadvantages of the prior art methods of this general type, in which the effects of sticking are minimized.

With the foregoing and other objects in view there is provided, in accordance with the invention, a method for controlling an electromechanical actuator drive for driving an actuator element. The electromechanical actuator drive has at least one coil for holding the actuator element in a given position. The method includes the steps of switching-off an energization of the coil a given time period before a point in time at which the actuator element is to be released from the given position; and determining the given time period in dependence on a supply voltage of the electromechanical actuator drive and/or a coil current while the actuator element is held in the given position.

A precise examination has shown that the sticking depends on a decrease in the current in the coil, and this depends in turn on the supply voltage of the actuator drive and of the coil current level during the holding in the limit position. For this reason, in one variant of the invention, at least one of these variables is sensed and the time period is selected as a function thereof.

It has also become apparent that the mechanical sticking which is caused by adhesion effects in the actuator drive may he changed largely independently of the operating parameters and changed only slightly over the service life of the actuator drive. In contrast, the magnetic sticking caused by the decrease in the current in the coil depends on operating parameters of the actuator drive that can he sensed. In one preferred refinement of the method, the operating parameters are therefore sensed and used to determine a component time of the time period that is dependent on operating parameters. A constant variable, i.e. permanently stored variable, is used as a further component time, which, together with the above first component time, yields the time period. However, it can also be adapted by measuring the overall time period in a certain timing pattern.

With these methods, undesired control time fluctuations during the actuation of the actuator drive are avoided. In an internal combustion engine with electro-magnetically activated charge cycle valves, such control time fluctuations have a highly negative effect on exhaust gas emissions and smooth running, particularly when the inlet valves close.

In accordance with an added mode of the invention, there is the step of forming the given time period to be composed of two composite times including a first composite time and a second composite time, and only the first composite time is dependent on the coil current and/or the supply voltage.

In accordance with another mode of the invention, there is the step of selecting a constant value for the second composite time.

In accordance with further mode the invention, there is the step of adapting the second composite time in response to a determination of the given time period.

Other features which are considered as characteristic for the invention are set forth in the appended claims.

Although the invention is illustrated and described herein as embodied in a method for controlling an electromechanical actuator drive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
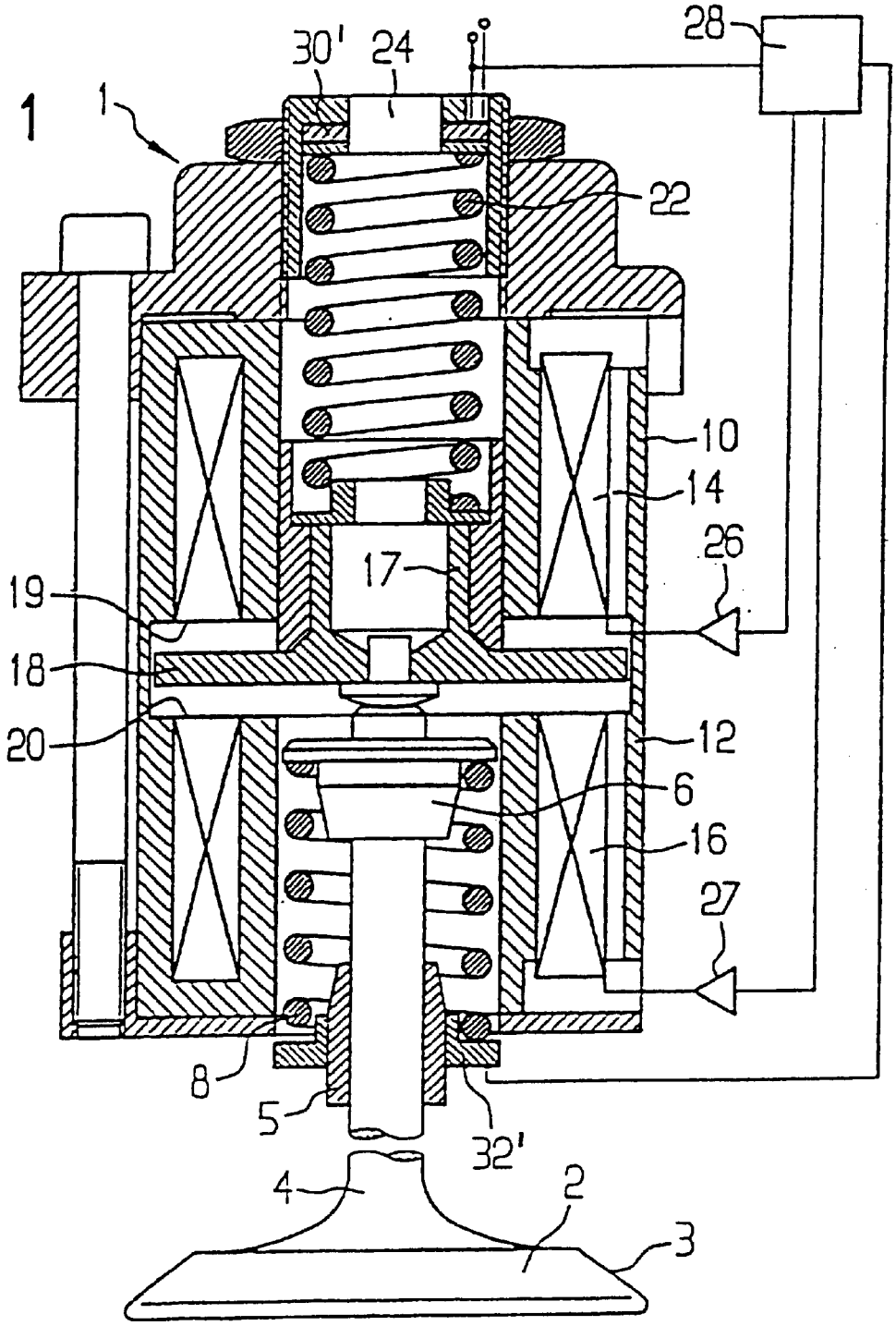
FIG. 1 is a diagrammatic, sectional view through an actuator drive for a charge cycle valve of an internal combustion engine according to the invention.

Referring now to the figures of the drawing in detail and first, particularly, to FIG. 1 thereof, there is shown an electromagnetic actuator drive 1 for a charge cycle valve which is embodied as a plate valve and is composed of a valve plate 2 with a valve seat 3 and a valve stem 4 which is mounted in a housing-end guide 5 and is provided with a conical element 6 at an upper end. The valve plate 2 is moved by the actuator drive 1 between two limit positions. The charge cycle valve is closed in an upper limit position and opened in a lower limit position. A valve spring 8 that is disposed between the housing-end guide 5 and the conical element 6 moves the valve plate 2 into the closed position.

The actuator drive 1 includes an upper ferromagnetic coil former 10 and a lower ferromagnetic coil former 12, which are each fitted with a coil 14 and 16.

An armature stem 17, which has a plate-shaped armature 18 that lies between the two coils 14, 16, is mounted such that it can be displaced within the upper coil former 10. End sides 19 and 20, facing the armature 18, of the two coil formers 10 and 12 form stops for the armature 18 and thus define the upper and lower limit position of the charge cycle valve in which it is opened and closed, respectively.

An actuator spring 22 is clamped in between the armature stem 17 and a housing-end stop 24 and moves the armature 18 in the direction of the open position of the valve plate 2. The armature 18 bears on the valve stem 4. As long as the coils 14 and 16 are de-energized, the armature 18 is held in the center position between the two end sides 19 and 20, as shown in the drawing, by the valve spring 8 and the actuator spring 22.

The two coils 14 and 16 are each energized by a driver circuit 26, 27, which is driven by a control circuit 28.

A piezo element 30' for measuring the travel of the armature plate 2 is also provided on an actuator spring support. A further piezo element 32' is provided on the housing-end guide 5. Output signals from the two piezo elements 30', 32' are fed to the control circuit 28, which uses them to control the impact speed of the armature 18 on the coil formers 10 and 12 at the end sides 19 and 20 in such a way that the valve can be moved quickly into the respective limit position at the desired time without bouncing and with little noise.

Figure 3:
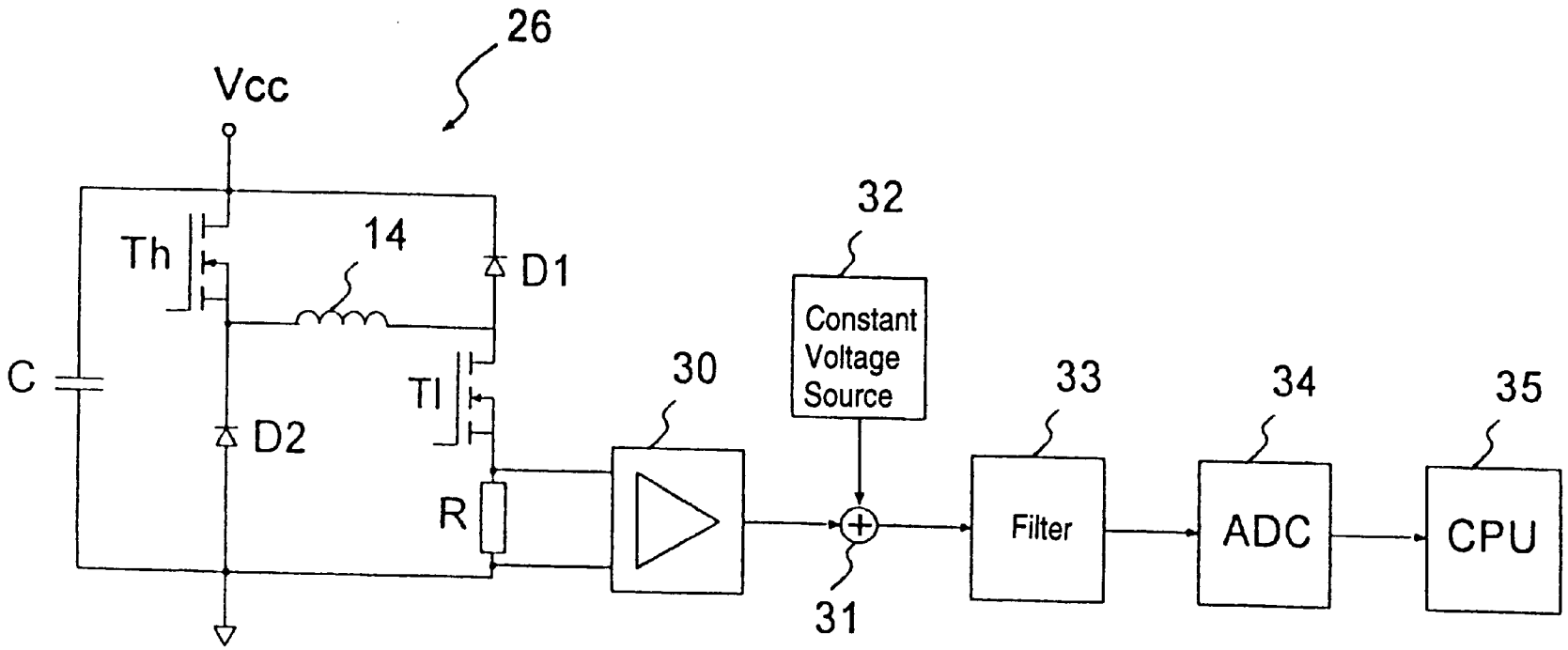
FIG. 3 is a block circuit diagram of the driver circuit.

The driver circuit is illustrated together with a more precise representation of the control circuit 28 in FIG. 3 by way of example. FIG. 3 shows the driver circuit 26 for the coil 14. The driver circuit 27 is of an analog configuration.

The coil 14 is actuated, as shown in FIG. 3, by an asymmetrical half bridge. Here, the coil 14 is connected between a high side FET Th, which is connected at the other end to a supply voltage Vcc, and a low side FET T1, which is in turn connected at the other end to the reference potential via a resistor R. A diode D2 is connected in a conductive direction between a reference potential and a node of the coil 14 that connects to the high side FET Th. A diode D1 is connected in the conductive direction between the node of the coil 14 that connects to the low side FET T1, and the supply voltage Vcc. Finally, the supply voltage Vcc is connected to the reference potential via a capacitor C. The resistor R is located in between the low side FET T1 and the reference potential.

A setpoint current is set in the coil 14 by switching the high side and/or low side FET Th, T1 on and off. Here, the actual current is measured over the voltage drop at the resistor R in the low side branch. The voltage drop is tapped by a difference amplifier 30 whose output value is fed to a filter 33 and also to an analog/digital converter 34 and a microcontroller 35 via an adder node 31 to which a constant voltage source 32 is also fed.

Figures 2A, 2B, 2C:
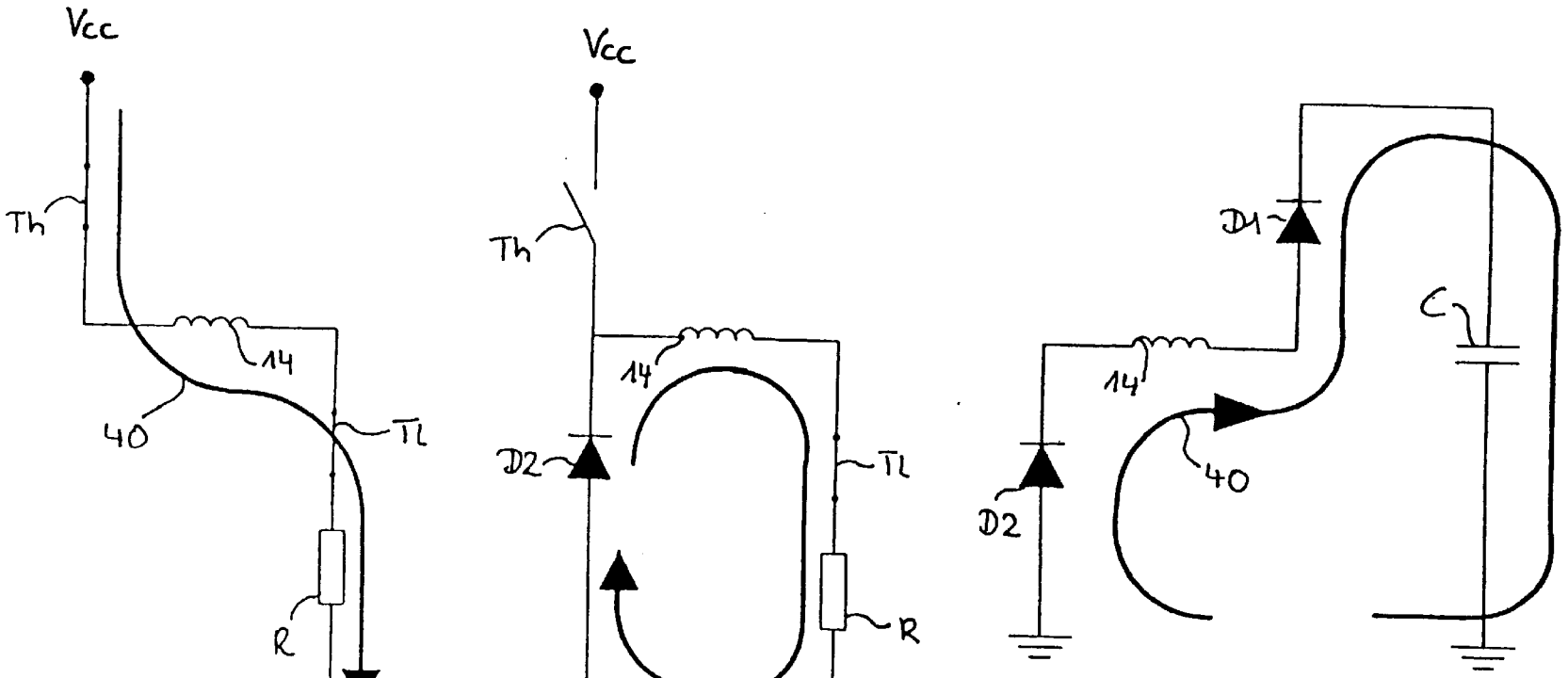
FIGS. 2*a*, 2*b* and 2*c* are current profiles in a driver circuit of a coil of the actuator drive.

FIGS. 2*a* to 2*c* then show the current flow in the circuit 26 in different operating states of the actuator drive. The elements corresponding to FIG. 3 are characterized with the same reference symbols here.

FIG. 2*a* shows the energization of the coil 14 during the holding of the actuator drive in the limit position in which the charge cycle valve is closed. Here, the current flows in the direction of an arrow designated by 40, from the supply voltage Vcc via the conductive high side FET Th, through the coil 14 and the likewise conductive low side FET T1 and through the resistor R to the reference potential. The switching off of the coil can be seen in FIG. 2*b*. For this purpose, the high side FET Th is opened. The energy stored in the coil 14 is then decreased by the flow of current in the direction of the arrow 40 via the low side FET T1 and the diode D2. In order to terminate the energization of the coil more quickly, the driver circuit 26 can be switched in the manner described in FIG. 2*c*. For this purpose, the low side FET T1 is also opened. This state is referred to as "clamping" and discharges the coil 14 through a flow current in the direction of the arrow 40 via the diodes D2 and D1 and the correspondingly biased capacitor C. By clamping the coil, the coil current can be switched off much more quickly than by merely switching it off, as illustrated in FIG. 2*b*.

The current in the coil 14 drops with an exponential function in the case of clamping. The drop is illustrated in the time sequence in FIG. 4 in the upper curve. The time constant of the exponential drop is determined by the level of the supply voltage. The higher the supply voltage, the quicker the decrease in current in the coil 14. The initial current level, i.e. the current with which the coil 14 is energized in the circuit in FIG. 2*a*, does not influence the time constant of the exponential drop, but certainly influences the period of time until the current has sufficiently decayed, i.e. until the actuator element is released from the limit position.

Figure 4:
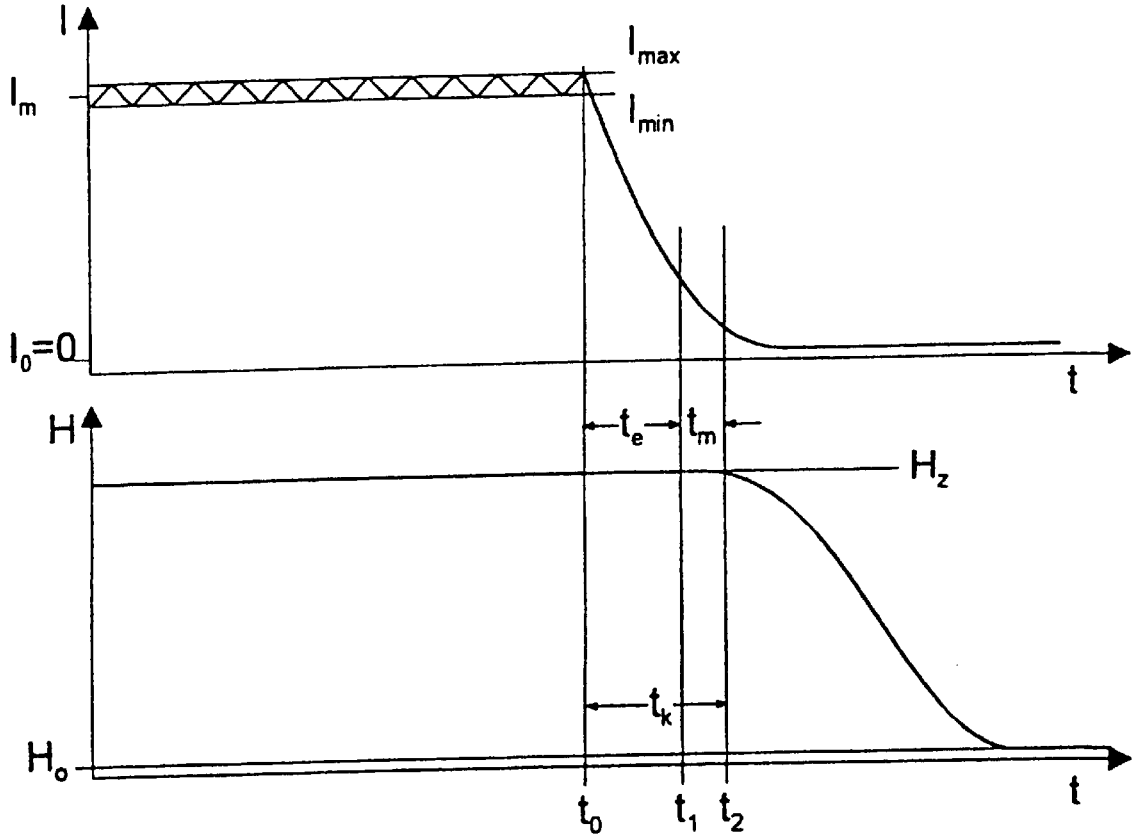
FIG. 4 is a graph showing a time profile of a coil current in the coil and a travel signal of a movement of the actuator element.

The effect of the "sticking" is illustrated in two time sequences in FIG. 4. The upper time sequence shows the profile of the energization of the coil 14 when the actuator element is held, for example the energization of the coil 14 in order to hold the armature 18 in the limit position in which the charge cycle valve is closed. A time t is plotted on the X axis and a current I on the Y axis. The associated travel signal H is plotted against time t on the curve below it, the travel signal H having been generated from the output signals of the two piezo elements 30', 32' in the control circuit 28.

As is apparent from FIG. 4, the coil 14 is energized up to the so time $t_0$ with a holding current $I_m$. Here, the current is controlled between the values $I_{min}$ and $I_{max}$ by the control circuit 28. At the time $t_0$, the coil 14 is clamped. As a result, the current I drops between the time $t_0$ and time $t_1$ to 0. This current level is designated by $I_0$ in FIG. 4. Starting from the time $t_1$, the coil 14 is thus no longer energized.

The associated travel signal H shows that the armature 18 does not become released from the limit position $H_z$ until a later time $t_2$. The armature 18 thus leaves the end side 19, to which the travel signal $H_z$ is assigned, only a time period $t_k$ after the point in time $t_0$ at which the clamping of the coil 14 was begun. During the time period $t_e$, in which the current in the coil 18 is reduced, the armature 18 remains on the end side 19; the travel signal is constant at the value $H_z$. This is caused by the magnetic "sticking" which is due to the time necessary for the reduction of the coil current. The travel signal also retains the value $H_z$ over the time period $t_m$, i.e. the armature 18 remains even longer on the end side 19, because of the mechanical "sticking" which is caused by additional adhesion effects in the actuator drive, for example as a result of an oil film or as a result of guide friction.

If the armature leaves the end side 19, it is moved, under the effect of the springs 22, 8, to the other limit position and captured there by a magnetic field generated by the coil 16. The time for this movement, referred to as "free flying", results from the square root of the quotient of the moved mass and the spring constant, multiplied by a factor of $2\pi$.

It goes without saying that these "sticking" effects relate equally to both limit positions.

Figure 5:
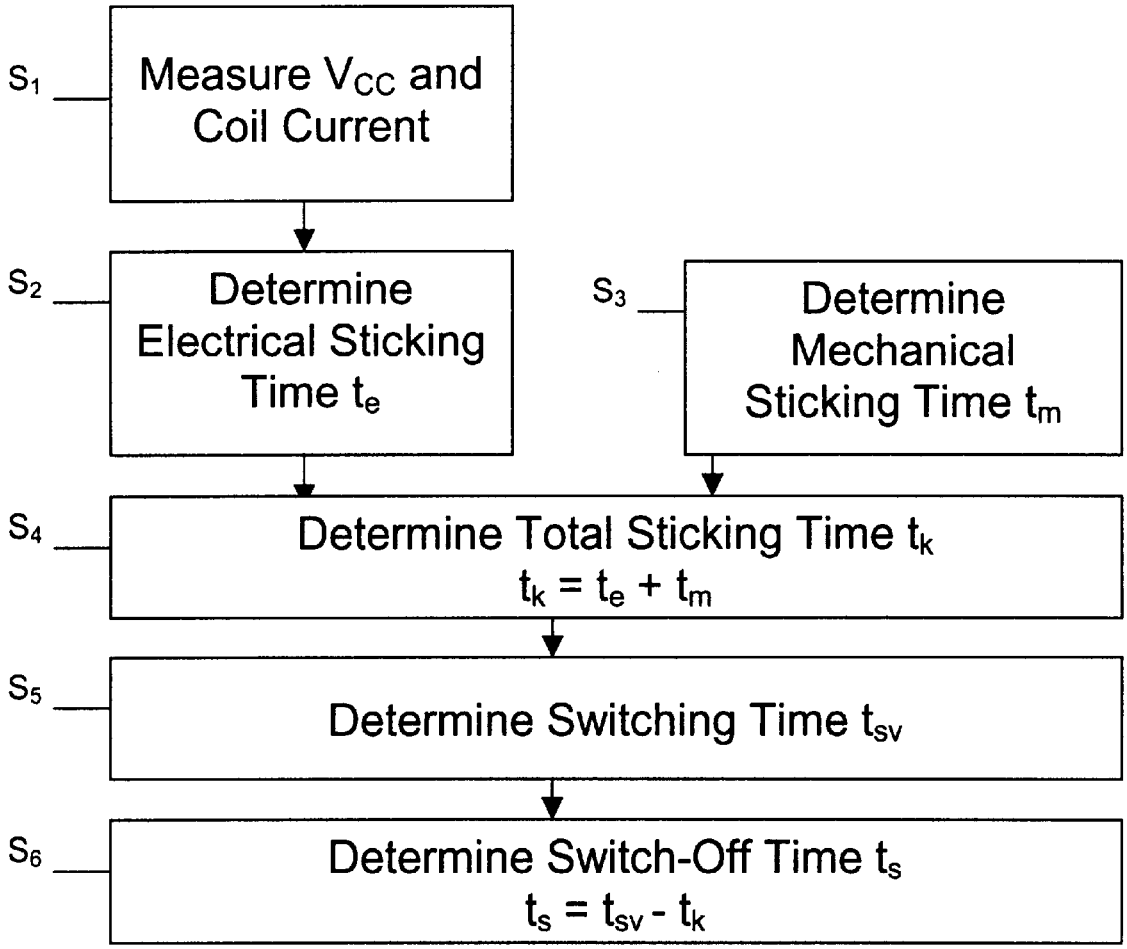
FIG. 5 is a first flowchart of a method for controlling the electromechanical actuator drive.

In order to ensure that the armature 18 or the charge cycle valve driven by the actuator element is released from the limit position at a predetermined time and starts the "free flying", a method is carried out whose sequence is illustrated schematically in FIG. 5.

In step S1, the supply voltage Vcc and the coil current $I(t_0)$ at the given time are measured. In step S2, the electrical sticking time $t_e$ is determined from these parameter values. This can be carried out, for example, by a characteristic diagram in which the corresponding sticking time for the parameters has been stored. Alternatively, this can also be carried out by the following equation:

$$I(t)=I(t_0)\cdot(1-\exp[-t/T1]).$$

Here, T1 designates the time constant of the exponential decay of the current, which time constant is determined as a function of the level of the supply voltage Vcc and can be obtained, for example, from a table which has been previously determined experimentally. From the above equation, it is possible, by simple resolution according to t, to determine the time period during which the current has dropped to a specific current $I_f$ at which the magnetic force brought about by the current becomes smaller than the resulting force of the springs 22 and 8 which moves the armature into the center position. The current $I_f$ is known for a given actuator drive, or easily determined experimentally by slowly reducing the current $I_m$ until the armature 18 is released from the limit position.

In parallel with steps S1 and S2, the mechanical sticking time $t_m$ is determined, for example obtained from a characteristic diagram, in step S3. An alternative way of determining the mechanical sticking time $t_m$ will be explained in more detail below with reference to FIG. 6.

In step S4, the sticking times $t_e$ and $t_m$ are added to the time period $t_k$. In step S5, a switching time predefined value $t_{sv}$, at which the charge cycle valve is to leave the limit position, is determined in a known fashion.

In step S6, the time at which the energization of the coil is to be switched off, i.e. the coil is to be clamped, is then determined by subtracting the sticking time $t_k$ from the switching time predefined value $t_{sv}$ so that the switching time $t_s$ is obtained.

If the coil is then clamped at the switching time $t_s$, it is ensured that the armature 18 of the actuator drive or the charge cycle valve is released from the limit position at the desired switching time predefined value $t_{sv}$ and starts the "free flying".

Figure 6:
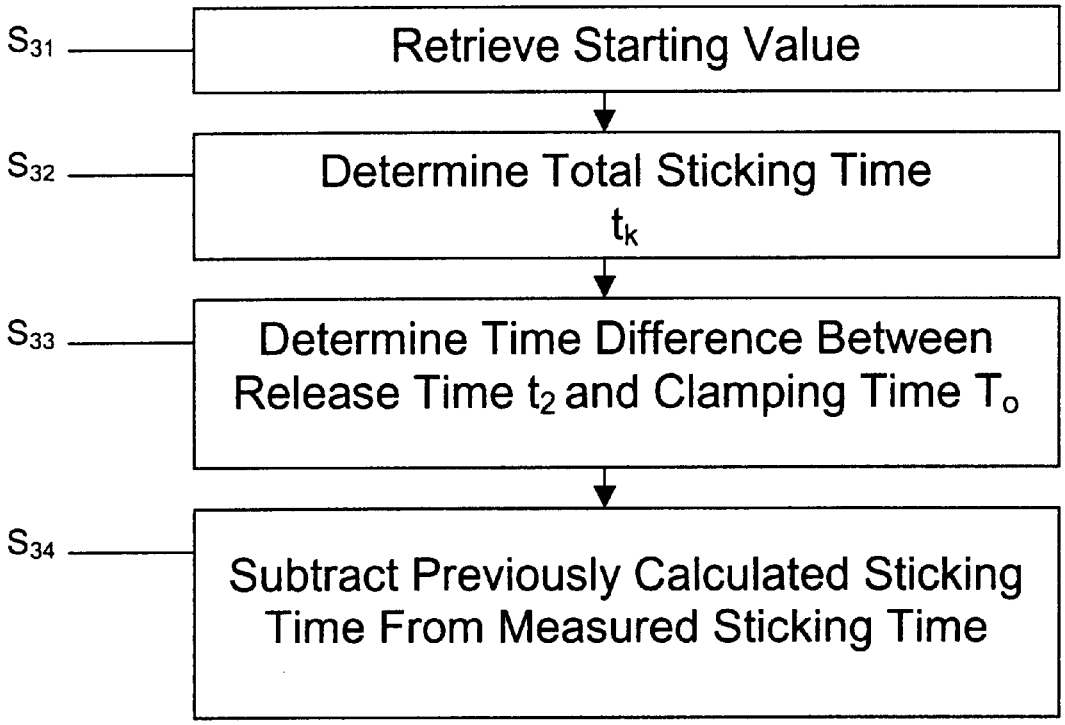
FIG. 6 is a second flowchart of the method.

As an alternative to obtaining the mechanical sticking time $t_m$ from a characteristic diagram in step S3, which, of course, signifies a fixed value for the mechanical sticking time $t_m$, the method steps illustrated in FIG. 6 can be run through. First, in step S31, a starting value of the mechanical sticking time for an adaptation method that then follows is obtained from a memory. The starting value can be a value that has been stored once or the value determined for the mechanical sticking time $t_m$ during the last operational cycle of the control circuit 28. Then, in step S32, the time period $t_k$ is determined for the first time with this starting value in accordance with the steps in FIG. 5 and is used to actuate the actuator drive. In step S33, the travel signal H is simultaneously monitored here and the time difference between the time $t_2$ at which the actuator element or the armature 18 is released from the limit position and the time $t_0$ at which the coil was clamped is determined. The time period $t_k$ that has actually been set during the operation of the actuator drive is thus obtained. In step S34, the value previously calculated in the method according to FIG. 5 for the time period $t_k$ is then subtracted from this measured value for the time period $t_k$. The difference can be positive or negative depending on whether the calculated value for the time period $t_k$ was longer or shorter than the measured value. The difference is then added to the value for the mechanical sticking time $t_m$ that is used as the basis in step S31. This value is then used for the next execution of the method according to FIG. 6 during the next passage through the step S31 so that the mechanical sticking time $t_m$ is continuously adapted.

With this adaptation, it is then possible to determine the difference between the starting value for the mechanical sticking time $t_m$ and the last value adapted. If the difference exceeds a certain threshold value, it is possible to conclude that there is a fault in the mechanical system and suitably display it or store it.

If it is desired to reduce the computational effort for the execution of the method, a modified version of the method according to FIG. 6 can be used. Here, it is not the mechanical sticking time $t_m$ that is adapted but rather the entire time period $t_k$. In step S31, a starting value for the time period $t_k$ is thus first obtained for the initial actuation of the actuator drive. This value is then adapted by measuring the time period $t_k$ that is actually obtained, in steps S32, S33 and S34, so that the last value measured for the time period $t_k$ is always used for each actuation of the actuator drive.

I claim:

1. A method for controlling an electromechanical actuator drive for driving an actuator element, the electromechanical actuator drive including a coil former having a coil, an armature and an end side facing the armature and forming stops for the armature to define a limit position of the actuator element, the method which comprises the steps of:

providing a supply voltage for generating a coil current;

energizing the coil with the coil current for holding the actuator element in a limit position in which the armature abuts the end side;

switching-off an energization of the coil a given time period before a point in time of release of the actuator element from the limit position; and determining the given time period while the actuator element is held in its limit position in dependence on at least one of the coil current and the supply voltage, and measuring the given time period while the actuator element is held in its limit position.

2. The method according to claim 1, which comprises forming the given time period to be composed of two composite times including a first composite time and a second composite time, and only the first composite time is dependent on at least one of the coil current and the supply voltage.

3. The method according to claim 2, which comprises selecting a constant value for the second composite time.

4. The method according to claim 2, which comprises adapting the second composite time in response to a determination of the given time period.

* * * * *